US007561712B2

(12) United States Patent
Akino

(10) Patent No.: US 7,561,712 B2
(45) Date of Patent: Jul. 14, 2009

(54) MICROPHONE DEVICE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 849 days.

(21) Appl. No.: 11/167,149

(22) Filed: Jun. 28, 2005

(65) Prior Publication Data

US 2006/0002576 A1 Jan. 5, 2006

(30) Foreign Application Priority Data

Jun. 30, 2004 (JP) ..... 2004-193130

(51) Int. Cl.
*H04R 21/02* (2006.01)

(52) U.S. Cl. ..... 381/361; 381/355; 381/368; 381/369; 381/363

(58) Field of Classification Search ..... 381/181, 381/91, 122, 355
See application file for complete search history.

(56) References Cited

U.S. PATENT DOCUMENTS 4,837,836 A * 6/1989 Barcus ..... 381/118
6,226,386 B1 * 5/2001 Akino ..... 381/173
6,647,118 B1 * 11/2003 Miura et al. ..... 379/433.03
6,898,294 B2 * 5/2005 Sekiguchi et al. ..... 381/369

* cited by examiner

*Primary Examiner*—Brian Ensey
*Assistant Examiner*—Sunita Joshi
(74) *Attorney, Agent, or Firm*—Manabu Kanesaka

(57) ABSTRACT

There is provided a microphone device which can positively prevent vibration noise caused by a microphone unit shaking its head back and forth. A microphone unit 24 is held by a unit mounter 23 composed of a plate-like elastic body 26, and the two upper and lower points of the unit mounter 23 are respectively fixed to upper and lower points of the microphone case, thereby preventing the microphone unit 24 from shaking its head.

4 Claims, 2 Drawing Sheets

MICROPHONE DEVICE

RELATED APPLICATIONS

The present application is based on, and claims priority from, Japanese Application Ser. No. JP2004-193130, filed Jun. 30, 2004, the disclosure of which is hereby incorporated by reference herein in its entirety.

TECHNICAL FIELD

The present invention relates to a microphone device and more specifically relates to a technique for a microphone device in which a microphone unit is supported in a microphone case so as not to shake back and forth, thereby preventing the occurrence of vibration noise.

BACKGROUND ART

Microphone devices include a condenser microphone and a dynamic microphone which inevitably have diaphragms vibrating with sound waves. A diaphragm vibrates not only with sound waves but also with, for example, vibrations propagated through a microphone case, resulting in the occurrence of noise. Most of the noise is handling noise generated by rubbing a microphone case with hands.

FIG. 4 is a front sectional view showing an example of a conventional stand microphone. In this example, a microphone 1 has a base 3 mounted in a microphone case 2. A microphone unit 4 is fixed on the base 3 via the lower end of the microphone unit 4. For example, Japanese Patent Application Publication No. 2003-92792 discloses such an example.

However, only one end of the conventional microphone unit 4 is supported on the base 3, and thus the microphone unit 4 shakes its head back and forth when the microphone 1 is touched, resulting in the occurrence of vibration noise.

SUMMARY OF THE INVENTION

In view of the problem of the conventional technique, an object of the present invention is to provide a microphone device in which a unit mounter comprising a microphone unit is supported on two upper and lower points in a microphone case to positively prevent vibration noise caused by the microphone unit shaking its head back and forth.

In order to attain the object, the present invention provides a microphone device having a microphone unit disposed in a microphone case, comprising a unit mounter in which the microphone unit is held by a plate-like elastic body, the unit mounter being configured such that the plate-like elastic body has upper and lower ends fixed to two upper and lower points of the microphone case.

According to a preferred embodiment, a holding window for holding the microphone unit is provided almost at the center of the plate-like elastic body, the microphone unit being held in the holding window.

With this configuration, the microphone unit is held by the plate-like elastic body to form the unit mounter, so that it is possible to effectively prevent the microphone unit from shaking its head back and forth and thus positively prevent vibration noise caused by the shaking.

DETAILED DESCRIPTION

Figure 1A:
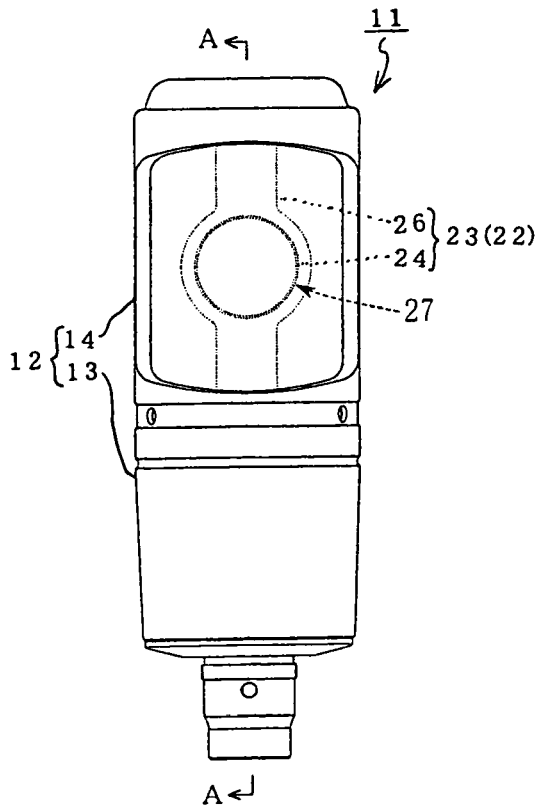
FIG. 1A is a front view showing a microphone device according to an embodiment of the present invention.
Figure 1B:
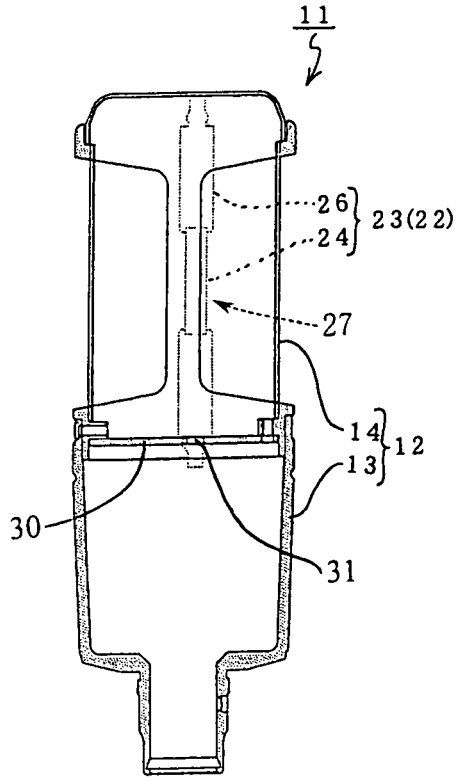
FIG. 1B is a diagram taken along line A-A of FIG. 1A.
Figure 2:
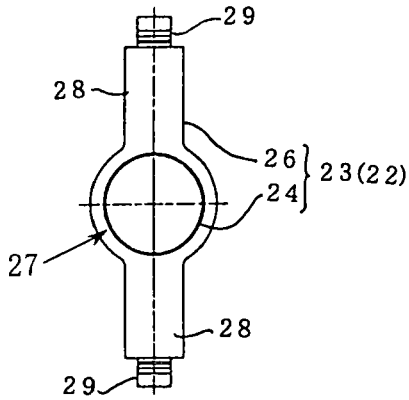
FIG. 2 is a front view showing a unit mounter.
Figure 3:
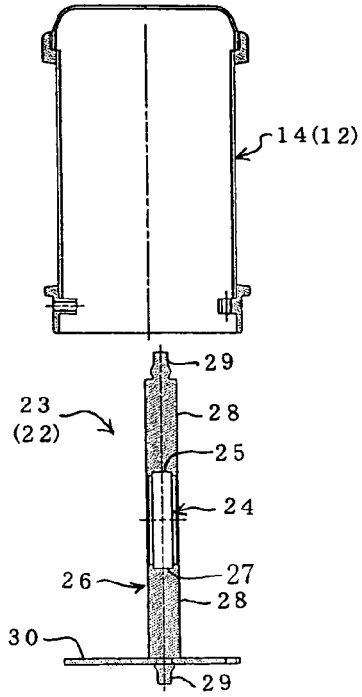
FIG. 3 is an exploded sectional view showing the arrangement of the unit mounter and a microphone case.
Figure 4:
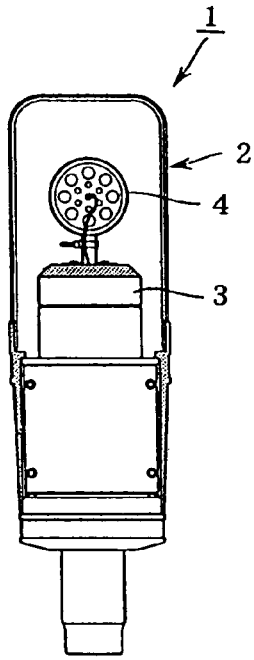
FIG. 4 PRIOR ART
FIG. 4 is a front sectional view showing a conventional example of a stand microphone.

FIG. 1A is a front view showing a microphone device according to an embodiment of the present invention. FIG. 1B is a diagram taken along line A-A, in which the internal structure is partially omitted. FIG. 2 is a front view showing a unit mounter of FIG. 1. FIG. 3 is an exploded sectional view showing the arrangement of the unit mounter and a microphone case.

In this configuration, a microphone device 11 supported on a stand (not shown) comprises a microphone case 12 and a microphone body 22 housed in the microphone case 12.

The microphone case 12 is divided into two of a lower case 13 connected to the stand and an upper case 14 surrounded by a punching metal. The lower case 13 houses an electric circuit board (not shown) including, for example, a signal amplifier circuit and an impedance converter composed of an FET which are constituent elements of the microphone body 22.

As shown in FIG. 2, the upper case 14 houses a unit mounter 23 which is a constituent element of the microphone body 22. The unit mounter 23 is formed of a condenser microphone unit 24 which is almost circular when viewed from the front and a plate-like elastic body 26 which holds the microphone unit 24.

The microphone unit 24 is formed as follows: a diaphragm, a spacer, and a fixed pole (none of them is shown) are housed in a unit case and combined therein.

The plate-like elastic body 26 is composed of a rubber plate which is larger in thickness than the microphone unit 24. An elastic material having rubber elasticity is used. Further, a holding window 27 for holding the microphone unit 24 is provided at the center of the plate-like elastic body 26. An outer periphery 25 of the microphone unit 24 is held in the holding window 27. A support plate 28 determined by the length of the upper case 14 is seamlessly provided above and below the holding window 27.

The plate-like elastic body 26 is positioned and fixed on two upper and lower points in the upper case 14 of the microphone case 12, thereby positively preventing vibration noise caused by the microphone unit 24 shaking its head back and forth.

As shown in FIG. 3, the plate-like elastic body 26 has elastic protrusions 29 respectively provided at the center of the lower end of the support plate 28 positioned under the holding window 27 and the center of the upper end of the support plate 28 positioned on the holding window 27. The elastic protrusion 29 at the center of the lower end is locked by a locking hole 31 on a bearing plate 30 arranged orthogonal to the elastic protrusion 29.

As shown in FIG. 1B, the bearing plate 30 is composed of a plate fixed on a boundary surface between the lower case 13 and the upper case 14 in the microphone case 12. The locking hole 31 for locking the elastic protrusion 29 of the plate-like elastic body 26 is provided almost at the center of the bearing plate 30.

The elastic protrusion 29 at the center of the upper end of the plate-like elastic body 26 is formed so as to be pressed to a top face inside the upper case 14 when the bearing plate 30 is fixed in the microphone case 12. With this configuration, the unit mounter 23 is fixed to the two upper and lower points in the microphone case 12. When the elastic protrusion 29 at the center of the upper end of the plate-like elastic body 26 is fixed to the microphone case 12, in addition to joining and fixation with an adhesive, it is possible to adopt proper fixing methods including joining and fixation with a double-sided adhesive tape, fixation simply by pressure welding, and screwing as necessary.

According to the present invention, the microphone unit 24 is held by the plate-like elastic body 26 to form the unit mounter 23, and the unit mounter 23 is fixed to the two upper and lower points of the microphone case 12 via the elastic body 26.

Therefore, unlike patent document 1 in which only one end of the microphone unit is supported, even when the microphone device 11 is held by a hand, it is possible to positively prevent the microphone unit 24 from shaking its head back and forth, thereby positively preventing vibration noise caused by such shaking.

Further, the microphone unit 24 is firmly held through the holding window 27 of the plate-like elastic body 26 so as not to fall, and thus even when a strong impact such as a drop impact is applied, the unity of the unit mounter 23 can be maintained.

The above explanation described the present invention in accordance with the illustrated example. The specific configuration is not limited to this example. For example, in a structure where a microphone unit is held by a plate-like elastic body, the microphone unit may be connected from the above and below, without being fit into a holding window, by using the plate-like elastic body according to a proper method.

The microphone unit may be either a single-diaphragm microphone unit or a double-diaphragm microphone unit. Further, the microphone device of the present invention is not limited to a condenser microphone and is also applicable to a dynamic microphone. Furthermore, the present invention is applicable to a handheld microphone in addition to a stand microphone. Any microphone can be included in the technical scope of the present invention as long as the microphone comprises a unit mounter constituted of a microphone unit and a plate-like elastic body.

The invention claimed is:

1. A microphone device, comprising:

a microphone case including an upper case and a lower case connected to the upper case, a bearing plate disposed in and fixed to the microphone case, and a microphone body disposed in the microphone case and comprising a microphone unit, and a unit mounter including a flat elastic body having a holding window provided at a middle portion thereof for holding the microphone unit and two support plates arranged to sandwich the holding window therebetween, each of said two support plates having an elastic protrusion protruding from an end portion thereof, wherein the elastic protrusions are fixed to the bearing plate and an inner surface of the upper case, and the flat elastic body has a width at the holding window greater than that of the two support plates.

2. The microphone device according to claim 1, wherein the bearing plate has a locking hole so that one of the elastic protrusions is engaged with the locking hole.

3. The microphone device according to claim 1, wherein the microphone body contacts the microphone case only through the two support plates.

4. The microphone device according to claim 1, wherein the flat elastic body is integrally formed together with the holding window completely penetrating therethrough.

* * * * *